US005717985A

United States Patent [19]

Labombard et al.

[11] Patent Number: 5,717,985

[45] Date of Patent: Feb. 10, 1998

[54] SINTERED METAL FIBER CORE BLOTTER ROLL AND METHOD OF MAKING SAME

[75] Inventors: Richard G. Labombard, Williamson; Ana M. Perez, Rochester; Karen E. Halliley, Marion, all of N.Y.

[73] Assignee: Xerox Corporation, Stamford, Conn.

[21] Appl. No.: 722,961

[22] Filed: Sep. 27, 1996

[51] Int. Cl.[6] ..... G03G 15/10

[52] U.S. Cl. ..... 399/249; 399/237; 399/248

[58] Field of Search ..... 399/222, 223, 399/233, 239, 248, 237, 249, 302, 348; 430/117, 119

[56] References Cited

U.S. PATENT DOCUMENTS

| | | | |
|---|---|---|---|
| 4,286,039 | 8/1981 | Landa et al. | 430/119 |
| 4,482,242 | 11/1984 | Moraw et al. | 399/249 |
| 4,985,733 | 1/1991 | Kurotori et al. | 355/282 |
| 5,136,334 | 8/1992 | Camis et al. | 355/256 |
| 5,332,642 | 7/1994 | Simms et al. | 430/125 |
| 5,424,813 | 6/1995 | Schlueter, Jr. et al. | 399/239 |
| 5,481,341 | 1/1996 | Sypula et al. | 399/239 |
| 5,519,476 | 5/1996 | Dalal et al. | 399/237 X |
| 5,537,194 | 7/1996 | Henry et al. | 399/237 X |
| 5,570,173 | 10/1996 | Nye et al. | 399/237 |

*Primary Examiner*—Sandra L. Brase
*Attorney, Agent, or Firm*—Tallam I. Nguti

[57] ABSTRACT

A method of forming an economical image conditioning device suitable for conditioning low solids and high solids images in a liquid Immersion Development reproduction machine. The method includes the steps of arranging a quantity of metallic fibers into a flat pattern having a desired thickness; partially compressing and sintering the fibers forming the pattern to create a sintered metallic fiber sheet held together by metallic bonds between touching fibers; rolling the sintered metallic fiber sheet into a cylindrical shape having a seam; welding the seam to create a finished cylindrical core; and forming a foam layer and a skin layer over the core for contacting an image being conditioned.

7 Claims, 2 Drawing Sheets

SINTERED METAL FIBER CORE BLOTTER ROLL AND METHOD OF MAKING SAME

BACKGROUND OF THE INVENTION

This invention relates to liquid immersion development (LID) reproduction machines, and more particularly to an economical low and high solids image conditioning device and method of making same, the conditioning device having a porous sintered metal fiber core blotter roll for both low and high quality conditioning of images in such a machine.

Liquid electrophotographic reproduction machines are well known, and generally each includes an image bearing member or photoreceptor having an image bearing surface on which latent images are formed and developed as single color or multiple color toner images for eventual transfer to a receiver substrate or copy sheet. Each such reproduction machine thus includes a development system or systems that each utilizes a liquid developer material typically having about 2 percent by weight of charged, solid particulate toner material of a particular color, that is dispersed at a desired concentration in a clear liquid carrier.

In the electrophotographic process of such a machine, the latent images formed on the image bearing surface of the image bearing member or photoreceptor are developed with the charged toner particles creating low solids liquid toner images, with some excess liquid carrier being left behind or removed, yielding high solids images typically each containing about 12 percent by weight of the toner particles. The developed image or images on the image bearing member are then further conditioned and subsequently electrostatically transferred from the image bearing surface to an intermediate transfer member. Following that, the image or images are again conditioned and then hot or heat transferred from the intermediate transfer member, at a heated transfer or transfix nip, to an output image receiver substrate or copy sheet.

Conditioning of liquid developer images as above methods must be achieved without disturbing each toner image, and in such a manner as to prevent toner particles from entering the carrier liquid removal device. In particular, the image must be conditioned uniformly without the conditioning device leaving undesirable outlines or footprints of the conditioning device in the conditioned image and in the case of a perforated roller without appearance differences between pore and non-pore contacted areas of the image.

In a color LID machine, low solids image conditioning typically utilizes four blotting devices such as four identical blotter rolls that each function to densify an initially developed liquid toner image from a low solids content of about a 5 percent solid toner particles content (by weight) to about a 20–25 percent such content. Low solids conditioning as such is needed to enable subsequent effective transfer of the liquid toner image from the photoreceptor belt or image bearing member to an intermediate belt where high solids content conditioning then takes place. High solids content conditioning utilizes a single blotting device to additionally remove fluid or carrier liquid from the about 20–25 percent solids content (by weight) toner image transferred to the intermediate, to yield a high solids image that is about 50–75 percent solids content (by weight). Blotter device characteristic (e.g. core rigidity and porosity) requirements are therefore reasonably different for quality conditioning of low versus high solids content LID images.

Conventionally, blotter rolls include a rigid cylindrical core that has perforations therethrough. Such a rigid cylindrical core may be produced, for example, by powdered metal technology. Powdered metal technology unfortunately is expensive and complicated, usually requiring secondary machining or grinding steps in order to achieve desired mechanical tolerances for the finished core. Such a rigid core can also be made by perforating a flat sheet of material as by stamping a sheet of stainless steel, nickel or aluminum. The perforated sheet is then rolled into a cylindrical shape and its adjoining ends, whether straight, spiral or overlapped, are then seamed or joined together, for example, by welding, soldering, or by adhesive bonding. In order to prevent a final blotter roll made from such a cylinder from dentrimentally disturbing an image being conditioned, the seam line formed in joining the ends of the shaped cylinder together must be secondarily ground so as to make it precisely even and level with the outer circumference of the cylinder. Excellent mechanical tolerances can be assured in such a cylinder but only at a relatively greater cost in proper selection of the starting materials, fixtures, and equipment needed for its fabrication.

Alternately, such a rigid core can be made by perforating a premade unperforated tubular member or blank by a suitable method. The tubular blank ordinarily would have to be rigid, and probably would be deformed during the perforation process. As such, it would have to be straightened after perforation in order to achieve required straightness and mechanical tolerances.

The other suggested methods of fabricating a metal core even of stainless steel, run the risks of poor structural rigidity of the core due to weakened core wall thickness. To be able to work with very thin walls, laser technology may be employed, but laser technology is extremely expensive and thus unfeasible for this application.

Usually however, conventional cores as such are typically not rigid enough to allow for application of a force sufficient to compact a high solids image, or are too rigid such that images conditioned with conventional devices made from them have been found to undesirably show significant evidence of pore hole outlines, and hole imprints or footprints from the rigid cores.

The following references may be relevant to various aspects of the present invention. For example, U.S. Pat. No. 4,286,039 issued Aug. 25, 1991, to Landa et al. discloses an image forming apparatus comprising a deformable polyurethane roller, which may be a squeegee roller or blotting roller which is biased by a potential having a sign the same as the sign of the charged toner particles in a liquid developer.

U.S. Pat. No. 4,985,733 issued Jan. 15, 1991, to Kurotori et. al. discloses a liquid toner copying machine including a non-thermal image conditioning apparatus comprising an elastic blotter roll and an elastic backup roller for bringing a liquid toner image carrying sheet into contact with the blotter roll.

U.S. Pat. No. 5,136,334 issued Aug. 4, 1992, to Carmis et. al. discloses a liquid toner image conditioning apparatus including a heated inner core connected to a source of AC or DC bias, and having a smooth outer surface made of a soft elastomeric material.

U.S. Pat. No. 5,332,642, issued Jul. 26, 1994, to Simms et al. having a common assignee as the present application, discloses a porous roller for increasing the solids content of an image formed from a liquid developer. The liquid dispersant absorbed through the roller is vacuumed out through a central cavity of the roller. The roller core and/or the absorbent material formed around the core may be biased with the same charge as the toner so that the toner is repelled from the roller while the dispersant is absorbed.

Each of the above example references includes a currently conventional and relatively expensive blotter device having a rigid core, and at least an absorbent layer over such core. It has been found that primary factors in the image disturbing characteristics of a conventional perforated core blotter device come, in part, from the inaccuracy, the lack of straightness, and image structure impact due to the degree of rigidity of the core. In addition, it was found that the structure of the liquid image conditioned with a conventional perforated core blotter device undesirably may show significant evidence of pore hole outlines, and hole imprints or footprints.

There is therefore a need for developing economical, methods of fabricating and, image non-disturbing substrates or cores for such blotter rolls that overcome the above difficulties.

SUMMARY OF THE INVENTION

In accordance with one aspect of the present invention, there is provided a method of forming an economical image conditioning device suitable for conditioning low solids and high solids images in a liquid Immersion Development reproduction machine. The method includes the steps of arranging a quantity of metallic fibers into a flat pattern having a desired thickness; partially compressing and sintering the fibers forming the pattern to create a sintered metallic fiber sheet held together by metallic bonds between touching fibers; rolling the sintered metallic fiber sheet into a cylindrical shape having a sea; welding the seam to create a finished cylindrical core; and forming a foam layer and a skin layer over the core for contacting an image being conditioned.

In accordance with another aspect of the present invention, there is provided an image conditioning device suitable for conditioning low solids and high solids images in a liquid immersion development reproduction machine. The image conditioning device includes an absorbent foam layer; a skin layer formed over the foam layer for contacting an image being conditioned; and a sintered metal fiber core assembled below the foam layer. The sintered metal fiber core consists of a cylindrically rolled sintered metallic fiber sheet having edges forming a seam when the sheet is rolled into a cylinder, and the sheet includes metal fibers that are arranged into a flat pattern defining a controlled porosity of the sheet, partially compressed, and sintered to create metallic bonds between touching fibers, thus forming the sheet.

BRIEF DESCRIPTION OF THE DRAWINGS

Other aspects of the present invention will become apparent as the following description proceeds and upon reference to the drawings, in which.

DETAILED DESCRIPTION OF THE INVENTION

Figure 1:
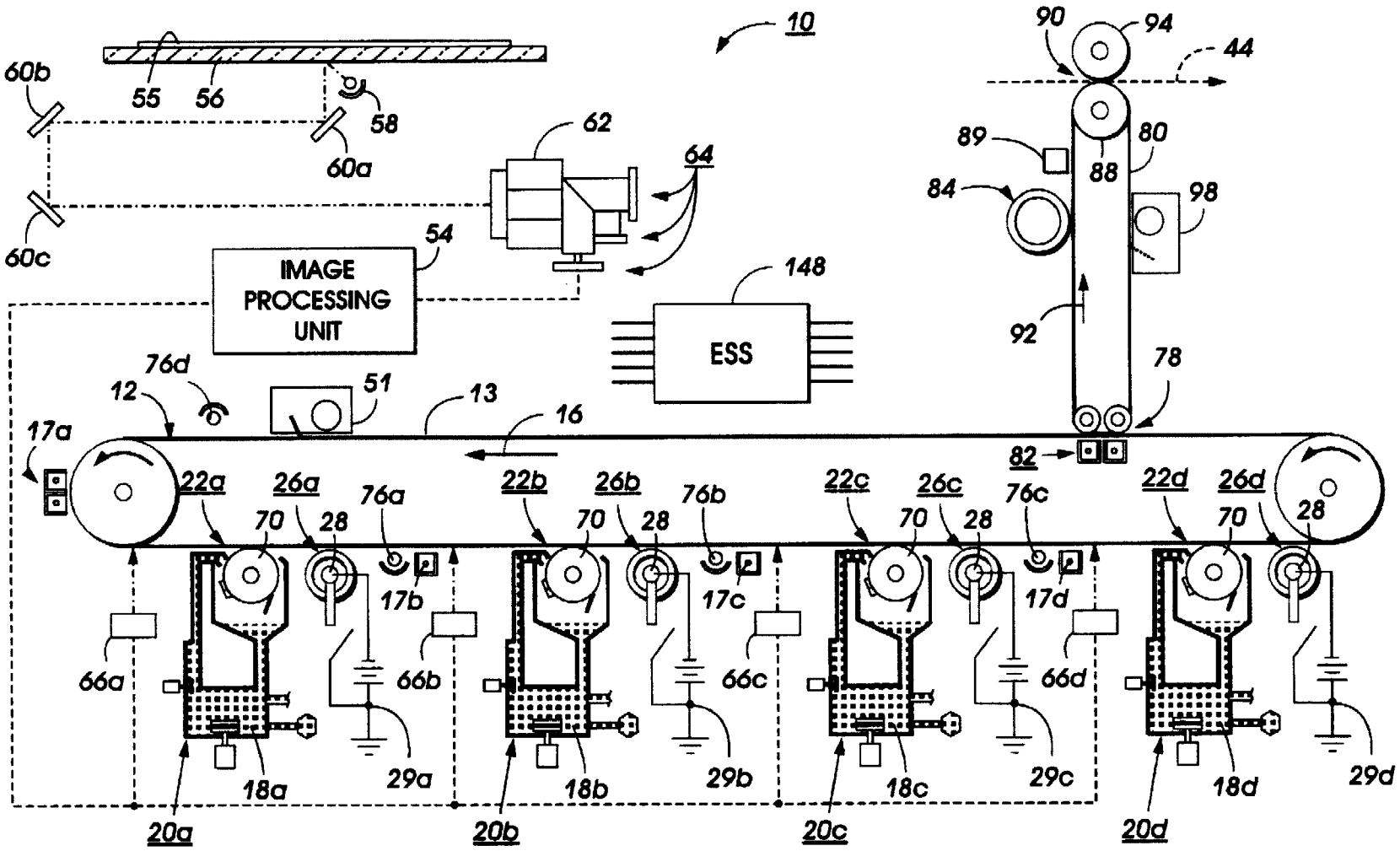
FIG. 1 is a vertical schematic of an exemplary color electrophotographic liquid immersion development (LID) reproduction machine incorporating a development system including the sintered metal fiber blotter roll device in accordance with the present invention.

For a general understanding of the features of the present invention, reference numerals have been used throughout to designate identical elements. It will become evident from the following discussion that the present invention is equally well suited for use in a wide variety of reproduction machines and is not necessarily limited in its application to the particular embodiment depicted herein.

Inasmuch as the art of electrophotographic reproduction is well known, the various processing stations employed in the FIGS. 1 and 2 of the reproduction machine will be shown hereinafter only schematically, and their operation described only briefly.

Referring now to FIG. 1, there is shown a color electrophotographic reproduction machine 10 incorporating a development system including the sintered metal fiber blotter roll device of the present invention. Although a multiple color LID machine is illustrated, it is understood that the invention is equally suitable for a single color LID machine. The color copy process of the machine 10 can begin by either inputting a computer generated color image into an image processing unit 54 or by way of example, placing a color document 55 to be copied on the surface of a transparent platen 56. A scanning assembly consisting of a halogen or tungsten lamp 58 which is used as a right source, and the light from it is exposed onto the color document 55. The light reflected from the color document 55 is reflected, for example, by a 1st, 2nd, and 3rd mirrors **60*a*, 60*b* and 60*c*, respectively through a set of lenses (not shown) and through a dichroic prism 62 to three charged-coupled devices (CCDs) 64** where the information is read.

The reflected light is separated into the three primary colors by the dichroic prism 62 and the CCDs 64. Each CCD 64 outputs an analog voltage which is proportional to the intensity of the incident light. The analog signal from each CCD 64 is converted into an 8-bit digital signal for each pixel (picture element) by an analog/digital converter (not shown). Each digital signal enters an image processing unit 54. The digital signals which represent the blue, green, and red density signals are converted in the image processing unit 54 into four bitmaps: yellow (Y), cyan (C), magenta (M), and black (Bk). The bitmap represents the value of exposure for each pixel, the color components as well as the color separation. Image processing unit 54 may contain a shading correction unit, an undercolor removal unit (UCR), a masking unit, a dithering unit, a gray level processing unit, and other imaging processing subsystems known in the art. The image processing unit 54 can store bitmap information for subsequent images or can operate in a real time mode.

The machine 10 includes a photoconductive imaging member or photoconductive belt 12 which is typically multilayered and has a substrate, a conductive layer, an optional adhesive layer, an optional hole blocking layer, a charge generating layer, a charge transport layer, a photoconductive or image forming surface 13, and, in some embodiments, an anti-curl backing layer. As shown, belt 12 is movable in the direction of arrow 16. The moving belt 12 is first charged by a charging unit **17*a*. A raster output scanner (ROS) device 66*a*, controlled by image processing unit 54, then writes a first complementary color image bitmap information by selectively erasing charges on the charged belt 12. The ROS 66*a*** writes the image information pixel by pixel in a line screen registration mode. It should be noted that either discharged area development (DAD) can be employed in which discharged portions are developed or charged area development (CAD) can be employed in which the charged portions are developed with toner.

Figure 2:
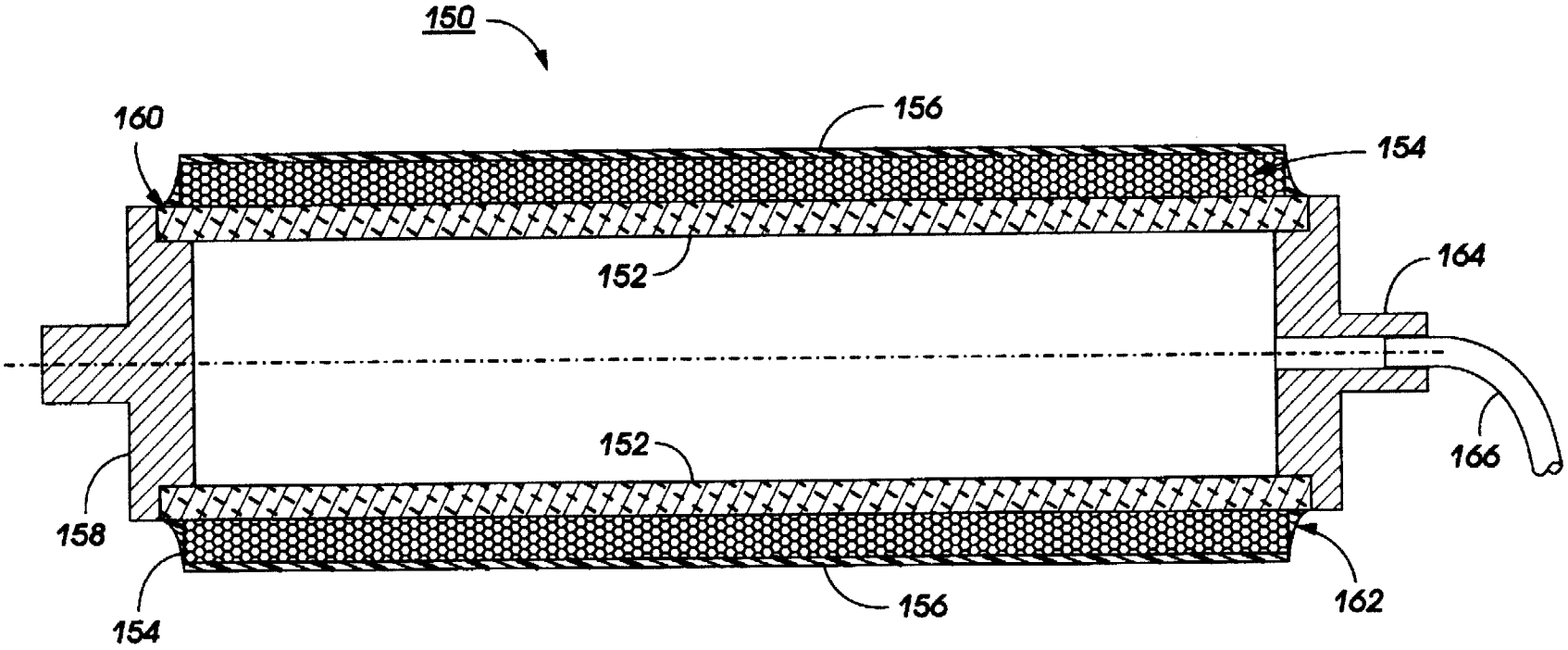
FIG. 2 is an enlarged schematic, sectional longitudinal view of the sintered metal fiber blotter roll device of FIG. 1.

Referring now to FIGS. 1 and 2, after the electrostatic latent image has been recorded thus, belt 12 advances it to a first development station **20*a*. Like subsequent development stations 20*b*, 20*c*, and 20*d***, the development station 20a includes a housing 21 defining a mixing chamber 23, a developer material delivery conduit 25, a development roller 70, and a spent developer material recovery chamber 27. The development roller 70, rotating in the direction as shown, advances a quantity of liquid developer material 18a, preferably black toner developer material containing charged black toner particles at a desired concentration, delivered to the roller 70 via the conduit 25, into a development zone or nip 22a. An electrode 24a positioned before the entrance to development zone or nip 22a is electrically biased to generate an AC field just prior to the entrance to development zone or nip 22a so as to disperse to the toner particles substantially uniformly throughout the liquid carrier. The toner particles, disseminated at the desired concentration through the liquid carrier, pass by electrophoresis to the electrostatic latent image forming a fast liquid color separation developed image. As is well known, the charge of the toner particles is opposite in polarity to the charge on the photoconductive or image forming surface 13.

After the first liquid color separation image is developed, for example, with black liquid toner, it is yet a low solids content image, and it is then conditioned by the sintered metal fiber blotter device 26a, which is the same as subsequent identical devices 26b, 26c, 26d, made in accordance with the present invention (the structure and fabrication of which will be described in detail below). The device 26a, 26b, 26c, 26d as mounted contacts the low solids image on belt 12 and conditions it by compacting the toner particles that form it, and by reducing the fluid content of the image (thus increasing its percent solids resulting in a high solids content image) while inhibiting the departure of toner particles from the image. Preferably, the percent solids content achieved in the high solids image is more than 20 percent by weight. A Vacuum device 28 located on one end of the device 26a, 26b, 26c, 26d, draws liquid that has permeated into the device, out through such end. Vacuum device 28 deposits the liquid in a receptacle or some other location for either disposal or recirculation as liquid carrier.

In operation, the device 26a, 26b, 26c, 26d rotates in a direction as shown with desired contact against the low solids image on belt 12. The porous body of device 26a, 26b, 26c, 26d preferably has a rigidity that enables image non-damaging force application, thus allowing the device to gently and effectively compact the low solids image, as well as, absorb some excess liquid from the surface of such image. The low solids conditioned image on belt 12 is then advanced to lamp 76a which floods the surface 13 with light for erasing residual charge left on the surface 13.

As shown, according to the REaD (i.e. Recharge, Expose and Develop) process of the machine 10, the developed latent image on belt 12 is subsequently recharged with charging unit 17b, and is next re-exposed by ROS 66b. ROS 66b superimposing a second color image bitmap information over the previous developed latent image. Preferably, for each subsequent exposure an adaptive exposure processor is employed that modulates the exposure level of the raster output scanner (ROS) for a given pixel as a function of toner previously developed at the pixel site, thereby allowing toner layers to be made independent of each other. Also, during subsequent exposure, the image is re-exposed in a line screen registration oriented along the process or slow scan direction. This orientation reduces motion quality errors and allows the utilization of near perfect transverse registration.

At the second development station 20b, a development roller 70, rotating particles of a second color, e.g. cyan, at a desired toner concentration, from the delivery conduit 25, to a second development zone or nip 22b. An electrode 24b positioned before the entrance to development zone or nip 22b is electrically biased to generate an AC field just prior to the entrance to development zone or nip 22b so as to disperse the toner particles substantially uniformly throughout the liquid carrier. The toner particles, disseminated through the liquid carrier, pass by electrophoresis to the previous developed image to develop a second low solids color separation image thereon.

The second low solids conditioning device 26b contacts the low solids image on belt 12 and conditions it similarly by sufficiently compacting the toner particles forming it, and reducing its fluid content, while inhibiting the departure of toner particles. Preferably, the percent solids achieved is more than 20 percent, however, the percent of solids can range between 15 percent and 40 percent. The conditioned images on belt 12 are then advanced to lamp 76b where any residual charge left on the photoconductive surface is erased by flooding it with light.

To similarly produce the third color separation image using the third toner color, for example magenta color toner, the developed images on moving belt 12 are recharged with charging unit 17c, and re-exposed by a ROS 66c, which superimposes a third color image bitmap information over the previous developed latent image. At the third development station 20c a development roller 70, rotating in the direction as shown, advances a magenta liquid developer material 18c, containing toner particles at a desired toner concentration, from the delivery conduit 25, to a third development zone or nip 22c. An electrode 24c positioned before the entrance to development zone or nip 22c is electrically biased to generate an AC field just prior to the entrance to development zone or nip 22c so as to disperse the toner particles substantially uniformly throughout the liquid carrier. The toner particles, disseminated through the liquid carrier, pass by electrophoresis to the previous developed image.

A third conditioning device 26c, in accordance with the present invention, contacts the developed low solids image on belt 12 and conditions the image by compacting it, thus reducing its fluid content so that the images have a percent solids within a range between 15 percent and 40 percent. The images or composite image on belt 12 are then advanced to lamp 76c where any residual charge left on the photoconductive surface of belt 12 is erased by flooding the photoconductive surface with light from the lamp.

Finally, to similarly produce the fourth color separation image using the fourth toner color, for example yellow color toner, the developed images on moving belt 12 are recharged with charging unit 17d, and re-exposed by a ROS 66d. ROS 66d superimposes a fourth color image bitmap information over the previous developed latent images. At the fourth development station 20d development roller 70, rotating in the direction as shown, advances a yellow liquid developer material 18d, containing toner particles at a desired toner concentration, from the delivery conduit 25, to a fourth development zone or nip 22d. An electrode 24d positioned before the entrance to development zone or nip 22d is electrically biased to generate an AC field just prior to the entrance to development zone or nip 22d so as to disperse the toner particles substantially uniformly throughout the liquid carrier. The toner particles, disseminated through the liquid carrier, pass by electrophoresis to the previous developed image.

A fourth conditioning device 26d, in accordance with the present invention, contacts the developed images on belt 12 and conditions them by reducing fluid their content so that the images have a percent solids within a range between 15 percent and 40 percent. It should be evident to one skilled in the art that the color of toner at each development station could be in a different arrangement.

The resultant composite multicolor image, a high solids multi layer image by virtue of low image conditioning, is then advanced to an intermediate transfer station 78. At the transfer station 78, the multicolor image is electrostatically transferred to an intermediate member 80 with the aid of a charging device 82. Intermediate member 80 may be either a rigid roll or an endless belt, as shown, having a path deemed by a plurality of rollers in contact with the inner surface thereof.

In accordance with an important aspect of the present invention, high solids image conditioning of the high solids multicolor image on the intermediate transfer member 80 is also achieved by means of a sintered metal fiber blotter device 84 made in accordance with the method of the present invention. Device 84 while not being as rigid as a powdered metal device, nontheless has sufficient rigidity for enabaling the application of a force sufficient to further compact a multilayered high solids content image, to effectively reduce the fluid content thereof. The sintered metal fiber blotter device 84 is adapted to condition the image as such so that the multilayer, multicolor image thereafter has a toner solids content of more than 50 percent(by weight).

Subsequently, the reconditioned image on the surface of the intermediate member 80 is advanced through a liquefaction stage before being transferred within a second transfer nip 90 to an image recording sheet 44. Within the liquefaction stage, particles of toner forming the transferred image are transformed by a heat source 89 into a tackified or molten state. The heat source 89 can also be applied to member 80 internally. The intermediate member 80 then continues to advance in the direction of arrow 92 until the tackified toner particles reach the transfer nip 90.

The transfer nip 90 is more specifically a transfixing nip, where the multicolor image is not only transferred to the recording sheet 44, but it is also fused or fixed by the application of appropriate heat and pressure. At transfix nip 90, the liquefied toner particles are forced, by a normal force applied through a backup pressure roll 94, into contact with the surface of recording sheet 44. Moreover, recording sheet 44 may have a previously transferred toner image present on a surface thereof as the result of a prior imaging operation, i.e. duplexing. The normal force, produces a nip pressure which is preferably about 20 psi, and may also be applied to the recording sheet via a resilient blade or similar spring-like member uniformly biased against the outer surface of the intermediate member across its width.

As the recording sheet 44 passes through the transfix nip 90 the tackified toner particles wet the surface of the recording sheet, and due to greater attractive forces between the paper and the tackified particles, as compared to the attraction between the tackified particles and a liquid-phobic surface of member 80, the tackified particles are completely transferred to the recording sheet. As shown, the surface of the intermediate transfer belt 80 is thereafter cleaned by a cleaning device 98 prior to receiving another toner image from the belt 12.

Invariably, after the multicolor image was transferred from the belt 12 to intermediate member 80, residual liquid developer material remained adhering to the photoconductive surface of belt 12. A cleaning device 51 including a roller formed of any appropriate synthetic resin, is therefore provided as shown and driven in a direction opposite to the direction of movement of belt 12 to scrub the photoconductive surface clean. It is understood, however, that a number of photoconductor cleaning means exist in the art, any of which would be suitable for use with the present invention. Any residual charge left on the photoconductive surface after such cleaning is erased by flooding the photoconductive surface with light from a lamp **76*d* prior to again charging the belt 12** for producing another multicolor image as above.

As illustrated the reproduction machine 10 further includes an electronic control subsystem (ESS) shown as 148 for controlling various components and operating subsystems of the reproduction machine. ESS 148 thus may be a selfcontained, dedicated minicomputer, and may include at least one, and may be several programmable microprocessors for handling all the control data including control signals from control sensors for the various controllable aspects of the machine.

Referring now to FIGS. 1 and 2, there is shown a sintered metal fiber blotter device 150, collectively representing the sintered metal fiber blotter devices **26*a*–26*d*, and 84 of FIG. 1, made in accordance with the present invention. Thus, identical elements associated with the sintered metal fiber blotter devices 26*a*–26*d*, and 84 will be identified with like reference numerals in the the sintered metal fiber blotter device 150**.

As shown, the sintered metal fiber blotter roll device 150 includes a sintered fiber metal core 152, and a conductive, open cell foam layer 154 formed over the core 152. The foam layer 154 is in turn covered with a thin conductive membrane 156. A closed journal 158 is mounted at a first end 160 of the roll device 150. The other end 162 of the roll device 150 has an open journal 164, and includes a connection 166 for the vacuum device 28 (FIG. 1) for facilitating carrier fluid removal as described above.

According to the present invention, the sintered metal fiber blotter roll device 150 (i.e. **26*a*–26*d*, and 84 of FIG. 1) is advantageously suitable as both a low and a high solids liquid image conditioning device. The sintered metal fiber core 152** preferably is made of stainless steel fibers so as to achieve desired non-coroding characteristics, as well as, high structural integrity, with a high degree of control over core permeability and porosity.

The method of making the sintered metal fiber blotter roll device 150 (i.e. **26*a*–26*d*, and 84 of FIG. 1) includes an initial step of arranging a quantity of metallic fibers, preferably stainless steel fibers, into a flat pattern having a desired thickness, and then partially compressing and sintering the pattern in order to create a sintered metallic fiber sheet held together by metallic bonds between touching fibers. The next step involves rolling the sintered metallic fiber sheet into a cylindrical shape having edges forming a seam, and then joining the edges as by welding for example, to create a finished cylindrical core 152. The seam, and core surface may then be machined to achieve desired surface dimensional and uniformity tolerances. The foam layer 154 and skin 156 can then be formed conventionally over the core 152**.

Metal fibers of various sizes are of course available commercially, or can be easily made. Importantly therefore, in accordance with the present invention, fibers of different sizes can be mixed in the flat pattern arrangement. For example, different sizes of fibers can be used on different layers of a multilayer flat pattern for eventual outside-to-inside flowrate or flow pattern control. Different sizes of fibers can also be used in different areas of the same layer, such as larger size fibers being used in areas of the flat pattern that would eventually form the seam of a finished core. This can be done so as to provide larger but fewer holes (fewer due to welding effects) at the welded seam area that would match the flow rate elsewhere of many more but smaller holes. The structural characteristics (such as porosity and wall thickness), of the sintered metal fiber sheet, as well as, the flow characterisitics of carrier liquid through the finished core, can thus be closely monitored and designed, principally through a careful selection and arrangement of fiber sizes.

Sintered metal fiber core blotter roll devices, made in accordance with the present invention, have the potential for providing image blotting quality that is as good or better than that of powdered metal core blotter devices. Additionally, however, the method of making sintered metal fiber core blotter devices (even at the relatively lower costs) provides for a relatively higher degree of control over core porosity and permeability, including side to side, and layer to layer controlled variation in such porosity and permeability.

As can be seen, a common porous blotter roll device having a sintered metal fiber core has been described for use in a Liquid Immersion Development (LID) machine for conditioning both low and high solids liquid toner images. Metal fibers have been found to provide desired structural properties for such a blotter roll core or substrate, particularly because metal fibers present an opportunity for precisely controlling the rigidity, porosity and permeability of such a blotter roll core. Image conditioning devices having metal fiber cores can have potentially the same or better image blotting quality as similar devices having conventional powdered metal cores. In addition, fabrication costs for a blotter roll having a sintered metal fiber core have been found to be relatively substantially lower than the same costs for fabricating a blotter roll having a powdered metal core.

While the invention has been described with reference to particular preferred embodiments, the invention is not limited to the specific examples shown, and other embodiments and modifications can be made by those skilled in the art without depending from the spirit and scope of the invention and claims.

What is claimed is:

1. A liquid immersion development (LID) reproduction machine comprising:

(a) a movable image forming member having an image forming surface defining a path of movement of said image forming member;

(b) means mounted along said path of movement for forming a latent image onto said image forming surface;

(c) development means mounted along said path of movement and containing liquid developer material consisting of a clear liquid carrier and solid charged toner particles at a desired contration level for developing the latent image to create a visible low solids content liquid toner image;

(d) an intermediate transfer member mounted along said path of movement, downstream of said development means and into contact with said image forming surface for receiving a high solids content liquid toner image from said image forming surface;

(e) a first economical sintered metal fiber image conditioning device mounted along said path of movement, downstream of said development means and into contact with the low solids content image formed by said development means, for effective high quality compacting of, and removal of excess carrier liquid from, the low solids content image to yield a high solids content image, said first sintered metal fiber image conditioning device including (i) a sintered metal fiber core having metal fibers of a selected size arranged as a flat pattern and sintered to form metallic bonds between touching fibers, (ii) a foam layer formed over said fiber core, and (iii) a skin layer formed over said foam layer; and (f) a second economical sintered metal fiber image conditioning device mounted into contact with the high solids content image, received onto said intermediate transfer member from said image forming surface, for effective high quality additional compacting of, and removal of excess carrier liquid from, the high solids content image, said second sintered metal fiber image conditioning device including (i) a sintered metal fiber core having metal fibers of a selected size arranged into a flat pattern and sintered to form metallic bonds between touching fibers, (ii) a foam layer formed over said core, and (iii) a skin layer formed over said foam layer.

2. In a liquid immersion development (LID) reproduction machine including a movable image forming member having an image forming surface, means for forming a latent image onto the image forming surface, development means containing liquid developer material consisting of a clear liquid carrier and solid charged toner particles for developing the latent image to create a visible low solids content liquid toner image, and an intermediate transfer member mounted downstream of the development means for receiving a high solids content liquid toner image from the image forming surface, an image conditioning device suitable for conditioning low solids and high solids images, the device comprising;

(a) an absorbent foam layer;

(b) a skin layer formed over said foam layer for contacting an image being conditioned; and (c) a sintered metal fiber core assembled below said foam layer, said sintered metal fiber core consisting of a cylindrically rolled sintered metallic fiber sheet having edges forming a seam when said sheet is rolled into a cylinder, said sheet including metal fibers arranged into a flat pattern defining a controlled porosity of said sheet, and said flat pattern being partially compressed, and sintered to form said sheet by creating metallic bonds between touching fibers.

3. The image conditioning device of claim 2, wherein said seam is welded.

4. The image conditioning device of claim 2, wherein said sheet includes different size metal fibers in different areas thereof for regulating porosity of such area.

5. The image conditioning device of claim 4, wherein said edges of said sheet are formed using fibers each having a size greater than that of each fiber used elsewhere in forming said sheet.

6. A method of forming an image conditioning device suitable for conditioning low solids and high solids images in a liquid immersion development reproduction machine, the method comprising the steps of:

(a) arranging a quantity of metallic fibers into a flat pattern having a desired thickness;

(b) partially compressing and sintering fibers forming the pattern to create a sintered metallic fiber sheet held together by metallic bonds between touching fibers;

(c) rolling the sintered metallic fiber sheet into a cylindrical shape having a seam;

(d) welding the seam to create a finished cylindrical core; and (e) forming a foam layer and a skin layer over the core for contacting an image being conditioned.

7. The method of claim 6, wherein said arranging step comprises arranging a quantity of stainless steel fibers.

* * * * *